United States Patent [19]

Komiyama

[11] 4,276,627

[45] Jun. 30, 1981

[54] MODULE STRUCTURE FOR ELECTRONIC DIGITAL TIMEPIECE

[75] Inventor: Katsuhiko Komiyama, Tokyo, Japan

[73] Assignee: Citizen Watch Company Limited, Tokyo, Japan

[21] Appl. No.: 12,564

[22] Filed: Feb. 15, 1979

[30] Foreign Application Priority Data

Feb. 20, 1978 [JP] Japan ..... 53-18310
Feb. 20, 1978 [JP] Japan ..... 53-18312

[51] Int. Cl.[3] ..... G04C 19/00; G04G 9/06

[52] U.S. Cl. ..... 368/84; 368/88; 368/318

[58] Field of Search ..... 58/4 A, 23 R, 23 AC, 58/23 BA, 50 R, 50 A, 52 A, 58, 59; 368/318, 84, 88, 239, 240–242; 340/758, 784; 350/331; 361/392, 395

[56] References Cited

U.S. PATENT DOCUMENTS

| | | | |
|---|---|---|---|
| 3,789,601 | 2/1974 | Begey | 58/50 R |
| 4,020,627 | 5/1977 | Yoshida et al. | 368/84 |
| 4,165,607 | 8/1979 | Fedorowicz et al. | 58/50 R |

*Primary Examiner*—Edith S. Jackmon
*Attorney, Agent, or Firm*—Holman & Stern

[57] ABSTRACT

A timepiece module having a liquid crystal display cell, a housing for supporting the liquid crystal display cell, a printed circuit substrate carrying thereon an LSI chip and various electronic components, a battery cell and a cover plate in which said battery cell and LSI chip are disposed on the same side on said printed circuit board.

15 Claims, 8 Drawing Figures

MODULE STRUCTURE FOR ELECTRONIC DIGITAL TIMEPIECE

The present invention relates to a module structure of an electronic watch which incorporates a power source, a quartz crystal providing a standard time signal, electronic circuits and a liquid crystal display device.

Digital watches are achieving widespread consumer acceptance in the marketplace, but this type of watches compared with hand-display quartz timepieces have unfavorably large thickness. Such thickness is partly derived from substantial thickness of a circuit board or substrate which carries electronic circuit components thereon. The substrate comprises a ceramic circuit board or a printed circuit board and supports a battery cell or cells which is or are the most massive among various constituent components of watch. Meanwhile, elaborate use of screws is a prerequisite in the assemblage of a watch module inasmuch as they offer the best means for the inter-connection of parts. However, it is practically impossible to form screwthreads in the substrate and it is difficult, to embed tapped tubes into the substrate.

An object of the present invention is to provide an improved module structure for an electronic wristwatch which realizes substantial reduction in thickness and number of components of the watch module.

Figure 1:
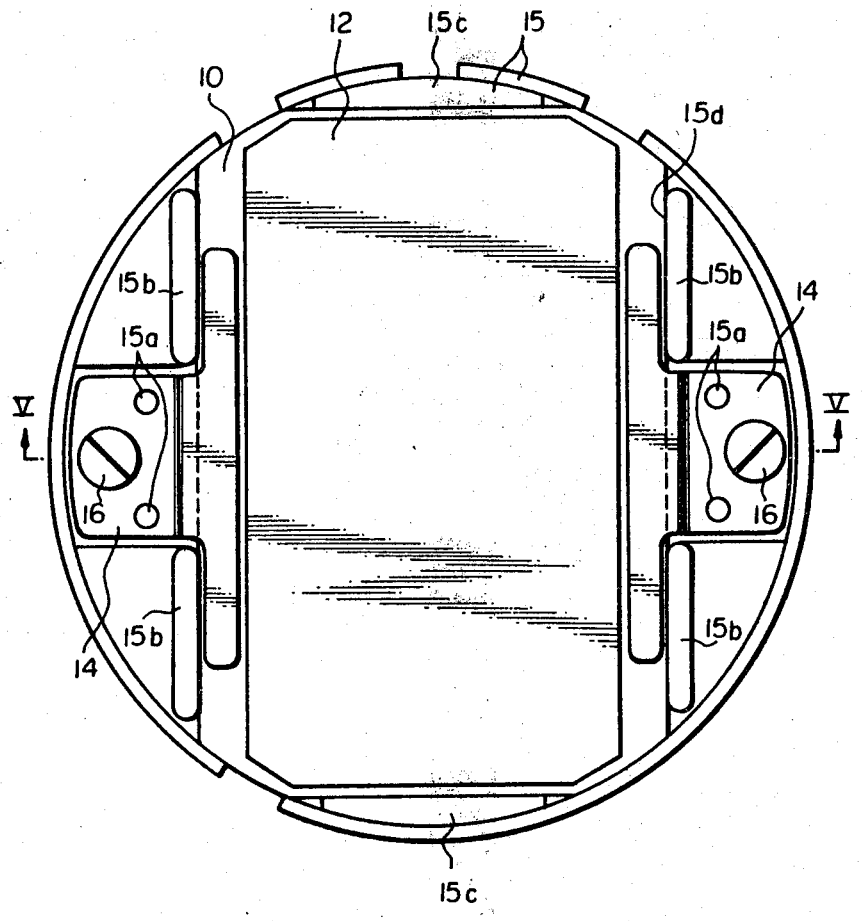
FIG. 1 is a plan view of an electronic watch module according to the present invention.

Referring now to FIG. 1, there is shown a plan view of a preferred embodiment of an electronic watch module according to the present invention. The watch module comprises a housing 15 having a plurality of axially extending lugs 15*b* and 15*c* which define a recess 15*d*. A liquid crystal display cell 10 is fit into the recess 15*d* and held in a fixed place by means of cell retaining springs 14. The cell retaining springs 14 are positioned by fixed pins 15*a* axially extending from the housing 15 and fastened thereto by screws 16.

Figure 4:
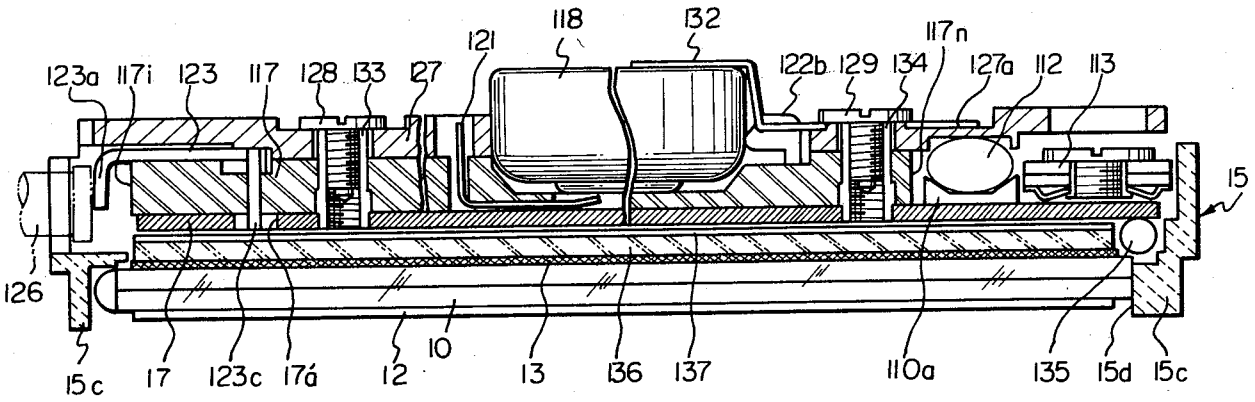
FIG. 4 is a cross section taken on line IV—IV of FIG. 2.
Figure 5:
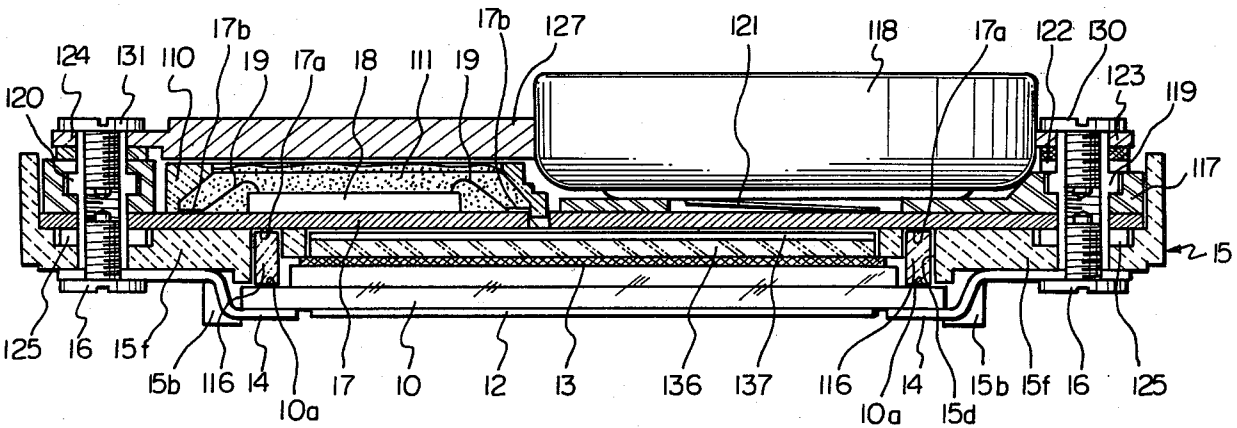
FIG. 5 is a cross section taken on line V—V of FIG. 1.

In FIGS. 4 and 5, the liquid crystal display cell 10 has a first polarizing plate 12 secured to one side of the cell and a second polarizing plate 13 secured to another side of the cell. The liquid crystal display cell thus arranged has first and second rows of electrical terminals 10*a* which are electrically connected to corresponding terminals of a circuit substrate 17 by means of electrically conductive rubber members 116 disposed in the recess 15*d* of the housing 15. The circuit substrate 17 is desirably made from an insulating material such as ceramic or other suitable material and placed on a flat wall portion 15*f* of the housing 15. The circuit substrate 17 has a first printed circuit pattern on a lower side of the substrate and a second printed circuit pattern formed on an upper side of the substrate, with the first printed circuit pattern being connected to the electrical terminals 17*a*. As shown in FIG. 5, a large scale integrated (L.S.I) circuit chip 18 is die-bonded to the upper side of the substrate 17 and wire-bonded to the printed circuit pattern 17*b* of the substrate through wires 19. The L.S.I. circuit chip 18 is packed in a mass of resin 111. To prevent flow of molded resin during packing operation, the mass of resin 111 is surrounded by a ring member 110 made from a suitable material such as polymeric material or the like.

Figure 3:
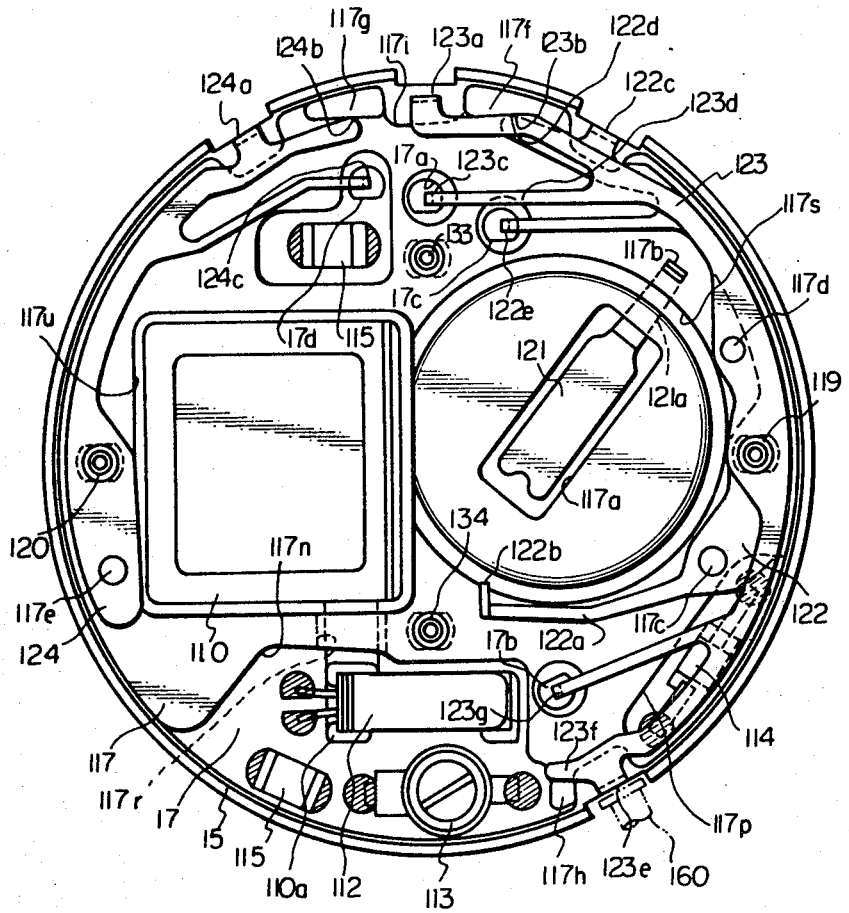
FIG. 3 is a plan view of the watch module in which the cover plate is removed.

As best shown in FIGS. 3 and 4, the ring member 110 has a bed 110*a* extending therefrom through a recess 117*r* of a protector frame 117 serving as a member for reinforcing the substrate 17. A quartz crystal vibrator 112 is disposed in a recess 117*n* of the protector frame and mounted on the bed 110*a*. The vibrator 112 has wires connected to the printed circuit pattern formed on the upper side of the substrate 17. A trim capacitor 113 is also disposed in the recess 117*n* of the protector frame 117 at a position adjacent the vibrator 112, to control the oscillating frequency of the vibrator 112. As shown in FIG. 3, the protector frame 117 also has a recess 117*p* in which a capacitor 114 is disposed for temperature compensation. A capacitor 115 is disposed in the recess 117*n* of the protector frame 117 for boosting the voltage level being applied to the liquid crystal display cell. The capacitors 113, 114 and 115 are electrically connected to the printed circuit pattern formed on the upper side of the substrate 17.

The protector frame 117 has first and second apertures 117*s* and 117*u* formed on an upper side of the frame, to accommodate therein a battery 118 and the L.S.I. circuit chip 18, respectively.

Connector tubes 119 and 120 are fit in the protector frame 117 and have collar portions to prevent rotation of the tubes during driving of screws. As shown in FIG. 3, the frame 117 is formed in its cell receiving portion with an opening 117*a* to accommodate a resilient cell retainer or negative cell contact 121 which provides electrical conduction between negative terminal of the cell 118 and negative circuit trace on the substrate 17. One end of the contact 121 is bent and fits in an opening 117*b* provided to the frame 117. Accordingly, the negative cell contact 121 is positioned by the opening 117*b* of the frame 117 and the peripheral portion of the aperture 117*s* of the frame 117 which restrains a portion 121*a* of the negative cell contact.

Spring contacts 122, 123 and 124 each having a flat shape are carried on the upper side of protector frame 117 and positioned respectively by pins 117*c*, 117*d* and 117*e* and tubes 119 and 120. One end portion 122*a* of the spring contact 122 has its extreme end 122*b* engaged with the side periphery of the battery cell 118 to provide electric conduction. Positive terminal of the cell 118 is electrically coupled with a positive terminal of the pattern on the substrate 17 by way of a positive cell contact 132, the tube 119 and its associated conductive washer 125. If desired, the washer 125 may be press fitted on the tube 119 to connect the frame 117 and substrate 17 integrally. The watch module thus constructed will be operated as follows.

The operation will be discussed in conjunction with the spring contact 123 for convenience. One end 123*a* of the spring contact 123 is axially bent and engages with a push button 126 provided to the watch case. A shoulder 123b of the spring contact 123 is engages with and positioned by a lug 117f protruding from the frame 117. When the end 123a is pushed by the button 126 radially inward, a bent portion 123c provided at an extreme end of one arm 123d of the spring contact 123 is caused to move from its central postion towards the wall of a generally D-shaped through-hole 17a provided to the substrate 17 and engages with the wall of the hole 17a. The engagement of the end 123c with the wall of the through-hole 17a is maintained due to the resiliency of the arm 123d insofar as the end 123a of the spring contact 123 is pressed by the button 126. The through-hole 17a is electrically coupled with a switch terminal of the L.S.I chip 18 and is formed with a switch contact electrode 17a' on its inner wall by known through-hole plating. A positive potential is applied from the battery to the spring contact 123 by way of the tube 119. Hence, in the above situation, the end 123c deposites a positive potential on the electrode 17a' of the D-shaped hole 17a whereby a switch associated with the electronic circuit of the L.S.I chip 18 is turned on. Upon the release of the switch button 126, the end 123c of the arm 123d is resiliently returned to the original position away from the switch contact electrode 17a', thereby turning the switch off. The radially inward movement of the spring contact 123 is limited by an indented wall 117i of the frame 117. In FIG. 3, another end portion 123e of the spring contact 123 is engageable with another switch button 160. A shoulder 123f of the spring contact 123 is positioned by a lug 117h projecting from the frame 117. When the end 123e is pressed by the corresponding switch button 160, an extreme end 123g of a neighboring arm will be brought into contact with a generally D-shaped through-hole 17b of the substrate 17 in the same way as the end 123c thereby turning the associated switch on. Likewise, the other spring contacts 122 and 124 are engageable with respective switch buttons at their ends 122c and 124a and positioned by lugs 117f and 117g of the frame 117 to which shoulders 122d and 124b are abutted, respectively. To turn associated switches on and off, ends 122e and 122c of the spring contact 122 are movable into and out of engagement with corresponding D-shaped through-holes 17c and 17d of the substrate 17 each being formed with an electrode. Operation of the spring contacts 122 and 124 is similar to that of the spring contact 123 and therefore will not be discussed. It will be seen from the foregoing that, since the frame 117 has a relatively intricate configuration, it should preferably be formed of a polymeric material from the viewpoint of cost and machining. Naturally, the protector frame may be made of a metallic material if desired. Denoted 127 is a back plate fixedly mounted by screws 128, 129, 130 and 31 to serve the functions of limiting the vertical positions of the spring contacts 122, 123 and 124, retaining the quartz oscillator with its resilient thin portion 127a and limiting the horizontal position of the battery cell 118. Tubes 133 and 134 are press fitted in the frame 117 so as to accommodate corresponding screws 128 and 129. Each of the tubes 133 and 134 is provided with a radial frange while having opposite ends notched to be restrained from dislodgment and/or rotation, which might otherwise occur when the screw 128 or 129 is driven thereinto. Preferably, the screw 128 is located adjacent to the ends 122e, 123c and 124c of the respective spring contacts with a view to avoiding their upward dislocation or floating.

Figure 2:
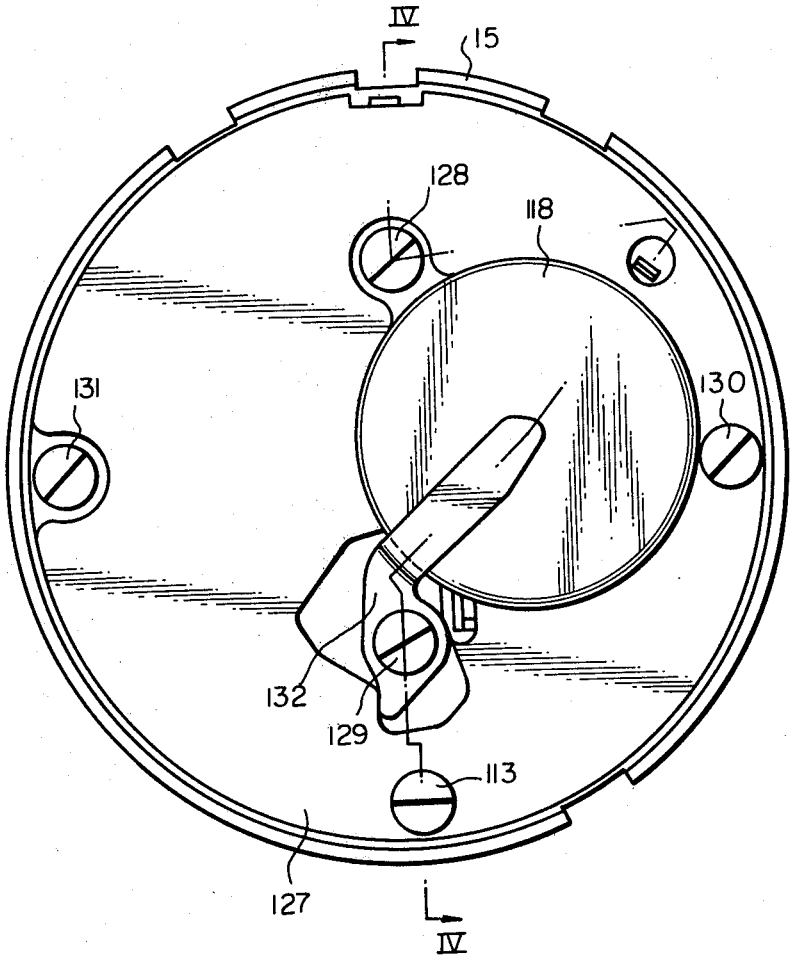
FIG. 2 is a bottom view of the watch module shown in FIG. 1.

Likewise, it is desirable for the screw 129 to retain the crystal in the neighborhood of the quartz oscillator. As seen in FIG. 2, the positive cell contact 132 is fixed in position by the screw 129 together with the back plate 127. Reference numerals 135, 136 and 137 indicate a lamp for nighttime illumination, a photoconductive plate and a reflector, respectively.

Figure 6:
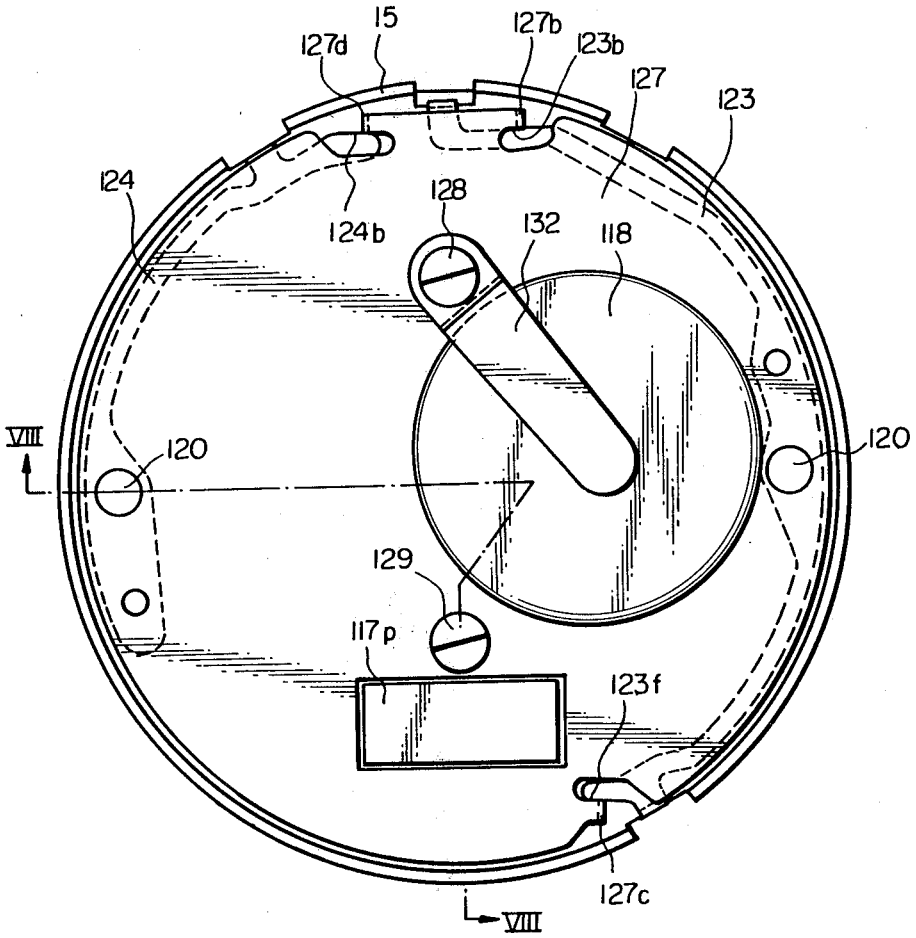
FIG. 6 is a bottom view of a modified form of the watch module shown in FIG. 1.
Figure 7:
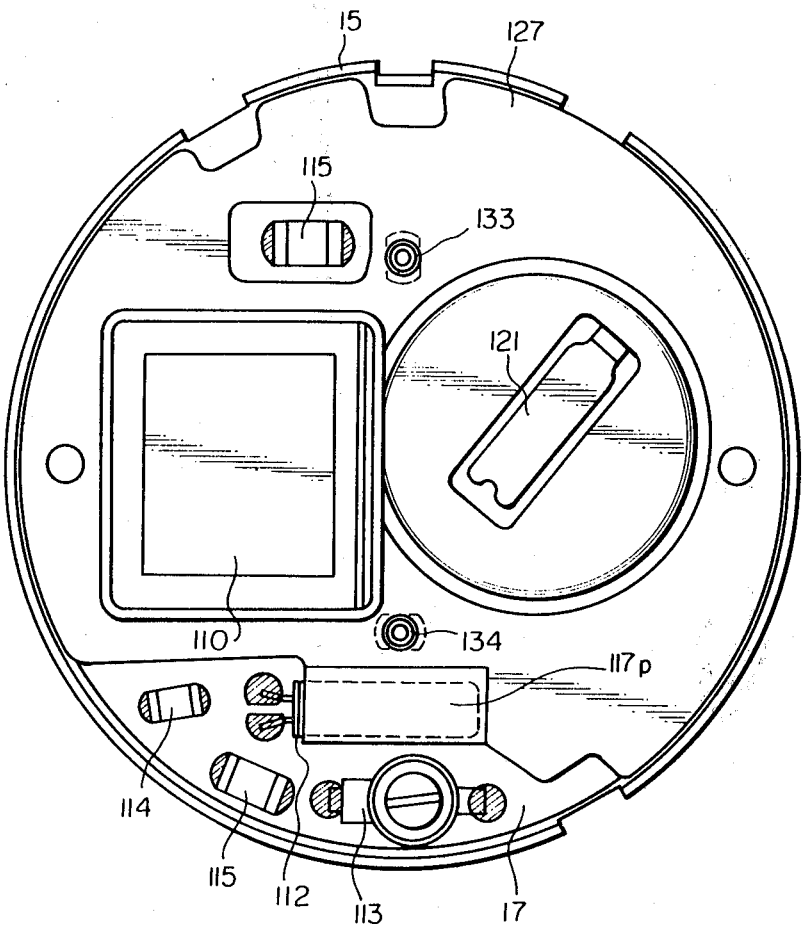
FIG. 7 is similar to FIG. 6 but shows a state in which the back plate is removed.
Figure 8:
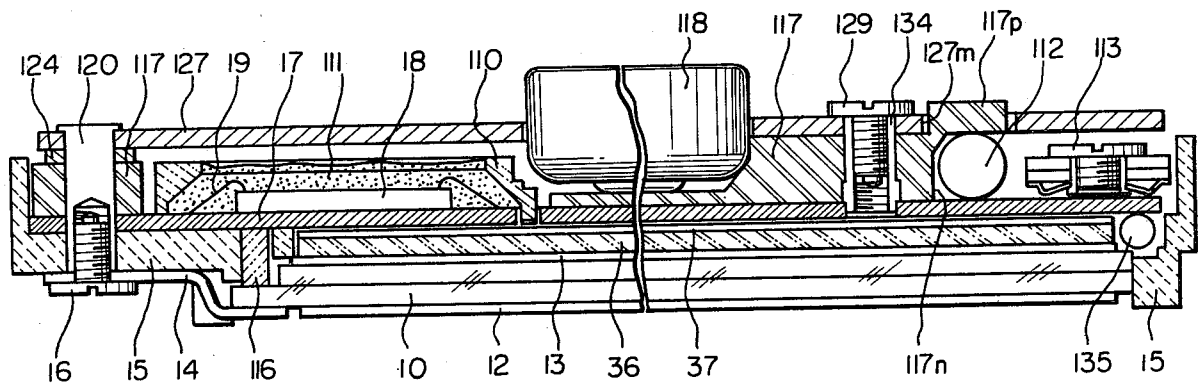
FIG. 8 is a cross section taken on line VIII—VIII of FIG. 6.

FIGS. 6 to 8 shows a modification of the watch module shown in FIGS. 1 to 5, with like parts bearing the same reference numerals as those used in FIGS. 1 to 5. In this modification, tubes 120 are fixedly mounted to the back plate 127 made of metal and serves as positioning members for positioning the protector frame 117, circuit substrate 17 and housing 15 relative to each other to provide easy assemblage of the module. In this modification, further, the supporting bed for the quartz crystal vibrator 112 is dispensed with and, instead thereof, the protector frame 117 is provided with an embossed portion 117p which is fitted into an aperture 127m to hold the quartz crystal vibrator 112. In FIG. 6, the back plate 127 has axially extending bent portions 127b, 127c and 127d with which the shoulder 123b of the spring contact 123, shoulder end 123f of the spring contact 123, and shoulder end 124b of the spring contact 124 engage, respectively, to be held in a fixed place. Other construction of the watch module of FIGS. 6 to 8 are similar to those of FIGS. 1 to 5 and therefore a detailed description of the same is omitted.

It will now be appreciated from the foregoing that, according to the present invention while a watch module has a battery cell overlayed on a liquid crystal cell but not on LSI chip, a watch using the module can achieve a substantial decrease in the thickness. A protector frame formed of a polymeric material adds to the rigidity of the module structure. Furthermore, part of the protector frame retains part of a quartz vibrator so that the number of necessary parts can be reduced.

What is claimed is:

1. An electronic watch module, comprising:

a housing made of electrically insulating material having one side formed with a first recess and having another side formed with a second recess;

a circuit substrate, having first and second substrate sides, disposed in the second recess of said housing and having an integrated circuit chip mounted on said first substrate side;

a protector frame disposed in the second recess of said housing and having a first side attached to said first substrate side and a second side formed with an aperture, said protector frame having a recess;

a battery cell accommodated in the aperture of said protector frame;

a quartz crystal vibrator disposed in the recess of said protector frame and mounted on said circuit substrate at the same side as said integrated circuit chip and said battery cell; and a liquid crystal display cell disposed in the first recess of said housing and facing to the second substrate side in close proximity thereto.

2. An electronic watch module according to claim 1, further comprising a back plate secured to said second side of said protector frame.

3. An electronic watch module according to claim 2, further comprising at least one connector tube partially embedded in said protector frame and serving as means for positioning said back plate and said housing relative to said protector frame.

4. An electronic watch module according to claim 2, in which said back plate is made of metal, and further comprising at least one connector tube fixed to said back plate for positioning said protector frame and said housing relative to said back plate.

5. An electronic watch module according to claim 1, in which said protector frame has at least one axially extending through-hole and said circuit substrate has at least one through-hole in registry with the through-hole of said protector frame in an axial direction, the through-hole of said circuit substrate having a contact portion connected to said integrated circuit chip.

6. An electronic watch module according to claim 5, further comprising at least one spring contact mounted on said protector frame and including a contact portion extending through the through-hole of said circuit substrate, said contact portion of said contact spring being movable to be brought into contact with the contact portion of said circuit substrate.

7. An electronic watch module according to claim 6, in which said spring contact has a flat, semi-circular configuration.

8. An electronic watch module, comprising:

a housing made of electrically insulating material having one side formed with a first axially extending recess and having another side formed with a second axially extending recess, said housing having a radially extending flat wall portion;

a protector frame, having first and second frame sides, disposed in the second axially extending recess of said housing and having said first frame side formed with a recess and having a cutout formed spaced away from said recess;

a circuit substrate, having first and second substrate sides, interposed between the second frame side and the radially extending flat wall portion of said housing, said substrate having an integrated circuit chip mounted on said first substrate side and received in the cutout of said protector frame to provide a time information signal, the circuit substrate also having electrical terminals printed on the second substrate side, the electrical terminals being electrically connected to said integrated circuit chip;

electrically conductive members disposed in the first axially-extending recess of said housing and electrically connected to the electrical terminals printed on said circuit substrate;

a liquid crystal display cell, having first and second cell sides, disposed in a central portion of the first axially extending recess of said housing, said first cell side facing the second substrate side in close proximity thereto, said display cell having electrical terminals printed on an inner surface thereof, the electrical terminals printed on said circuit substrate through said electrically conductive members to display a time information in response to said time information signal; and a battery cell disposed in the recess of said protector frame at a position adjacent to the integrated circuit chip in an non-overlapping manner with respect to said integrated circuit chip.

9. An electronic watch module according to claim 8, wherein said second frame side is formed with a second recess, and further comprising a quartz crystal vibrator disposed in the second recess of said protector frame and mounted on said circuit substrate at the same side as said integrated circuit chip and said battery cell.

10. An electronic watch module according to claim 8, further comprising a back plate secured to the first frame side of said protector frame.

11. An electronic watch module according to claim 10, further comprising at least one connector tube partially embedded in said protector frame and serving as means for positioning said back plate and said housing relative to said protector frame.

12. An electronic watch module according to claim 10, in which said back plate is made of metal, and further comprising at least one connector tube fixed to said back plate for positioning said protector frame and said housing relative to said back plate.

13. An electronic watch module according to claim 8, in which said protector frame has at least one axially extending through-hole and said circuit substrate has at least one through-hole in registry with the through-hole of said protector frame in an axial direction, the through-hole of said circuit substrate having a contact portion connected to said integrated circuit chip.

14. An electronic watch module according to claim 13, further comprising at least one spring contact mounted on said protector frame and including a contact portion extending through the through-hole of said circuit substrate, said contact portion of said contact spring being movable to be brought into contact with the contact portion of said circuit substrate.

15. An electronic watch module according to claim 14, in which said spring contact has a flat, semi-circular configuration.

* * * * *